US006123064A

United States Patent [19]

Jacquet

[11] Patent Number: 6,123,064

[45] Date of Patent: Sep. 26, 2000

[54] EVOLVING HEATING CONCEPT

[76] Inventor: Patrice Jacquet, 14100 St., Germain de Livet, France

[21] Appl. No.: 09/135,813

[22] Filed: Aug. 18, 1998

[51] Int. Cl.[7] ..... F24D 9/00; F24C 1/00; F23B 1/12; F22B 23/00

[52] U.S. Cl. ..... 126/101; 126/151; 126/243; 126/114; 126/60; 126/347; 110/295; 110/234; 122/209.1; 122/213; 122/240.1

[58] Field of Search ..... 126/243, 101, 126/242, 151, 114, 347, 60; 122/209.1, 209.2, 213, 214, 240.1; 110/295, 234

[56] References Cited

U.S. PATENT DOCUMENTS

| | | | |
|---|---|---|---|
| 72,530 | 12/1867 | Newell | 122/213 |
| 474,311 | 5/1892 | Waggoner | 122/213 |
| 492,664 | 2/1893 | Dietrich | 122/213 |
| 508,790 | 11/1893 | Warner | 122/213 |
| 633,897 | 9/1899 | Page | 122/213 |
| 672,400 | 4/1901 | Robbins | 122/213 |
| 739,503 | 9/1903 | Murphy | 122/213 |
| 1,277,751 | 9/1918 | Prochazka | 126/242 |
| 1,280,788 | 10/1918 | McKeown | 122/213 |
| 1,467,332 | 9/1923 | McIntire | 122/213 |
| 1,685,482 | 9/1928 | Doherty | 122/213 |
| 1,740,393 | 12/1929 | Cowles et al. | 122/213 |
| 1,776,352 | 9/1930 | Doherty | 122/213 |
| 3,934,554 | 1/1976 | Carlson | 126/101 |

FOREIGN PATENT DOCUMENTS

| | | |
|---|---|---|
| 2590969 | 6/1987 | France . |
| 492178 | 6/1970 | Switzerland . |

*Primary Examiner*—Ira S. Lazarus
*Assistant Examiner*—David Lee
*Attorney, Agent, or Firm*—Browdy and Neimark

[57] ABSTRACT

A heating system has a modular section which can be converted to use as a store or boiler and to burn either solid or liquid and gaseous fuels. The system can be further expanded by addition of more than one module to increase the heating capacity of the system.

5 Claims, 14 Drawing Sheets

EVOLVING HEATING CONCEPT

BACKGROUND OF THE INVENTION

1. Technical Field of the Invention

The present invention relates to an expandable, convertible and multifuel heating system having several different applications. One application is as a stove, which may then be expanded into a boiler for heating and circulating fluid (water, oil) towards a heating element such as radiators or any other radiant system.

The heating system in one form can be used to burn solid fuels, such as coal or wood, and in another form liquids or gaseous fuels.

2. Prior Art

At present, the choice of heating systems is determined principally by location which can limit use of the system to a particular fuel due to availability and cost. Conventional heating systems are further not expandable to heat supplemental space, such as a renovated attic.

OBJECT AND SUMMARY OF THE INVENTION

The object of this invention is to provide a modular component which can be adapted to burn either solid, liquid or gaseous fuels as either a stove or a boiler and can also be combined to increase the heating capacity of the system to serve expanded space as either a stove or a boiler. This is achieved by the use of supplementary elements, and without the need to change the basic structure of the modular component.

The novelty of this invention resides in three principal points which are:

a. A system possessing a heating power which is modular and expandable;

b. A stove that can be converted to a boiler; and c. The ability to use solid, liquid or gaseous fuels.

In brief, it is a heating system that can be increased or diminished according to the space to be heated, while maintaining an ability to be used as a stove, or a boiler.

DETAILED DESCRIPTION OF THE INVENTION

Figure 3:
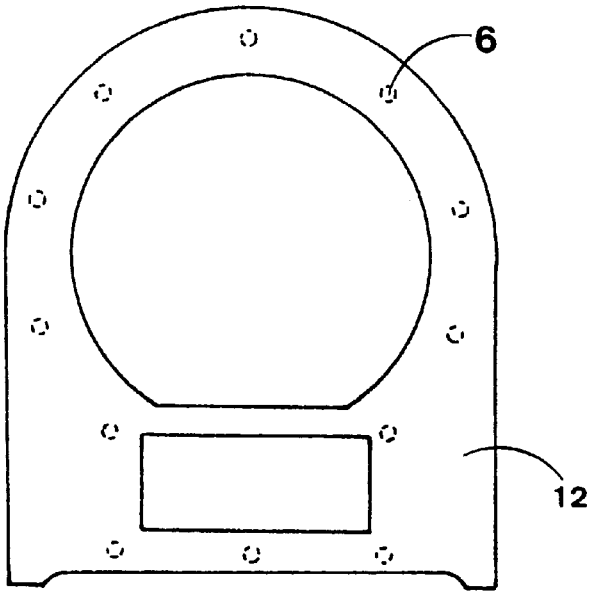
FIG. 3 is a front elevation view of the front panel for use with the modular cell of FIG. 1.
Figure 4:
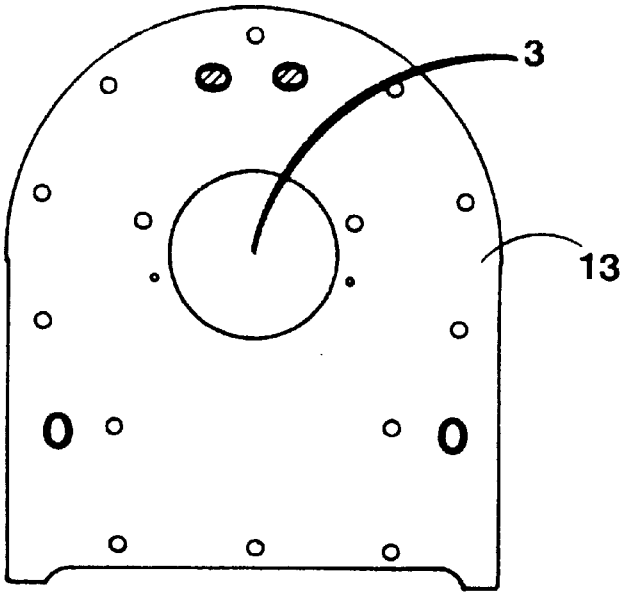
FIG. 4 is a front elevation view of the back panel for use with the modular cell of FIG. 1.

The modular cell 1 can be equipped with either a front panel 12 (see FIG. 3), equipped with a main door 10 (see FIG. 6) or 11 (see FIG. 7) and with a back part 13 (see FIG. 4) in which is disposed an opening 3 for evacuation of smoke and is equipped to receive additional elements discussed below when expanded for use as a boiler.

When burning solid fuels the front panel 12 is equipped with a main door 10 and mounted on lateral hinges to permit such opening to allow the introduction of solid fuels.

Figure 9:
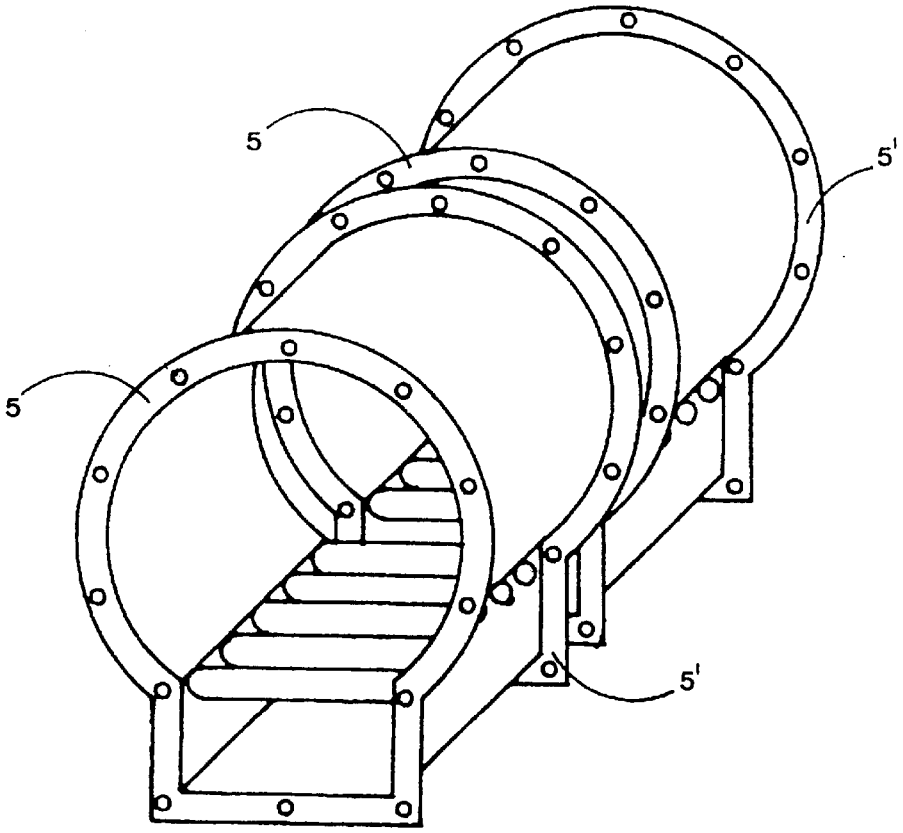
FIG. 9 is a perspective view of two unassembled cells of FIG. 1.
Figure 10:
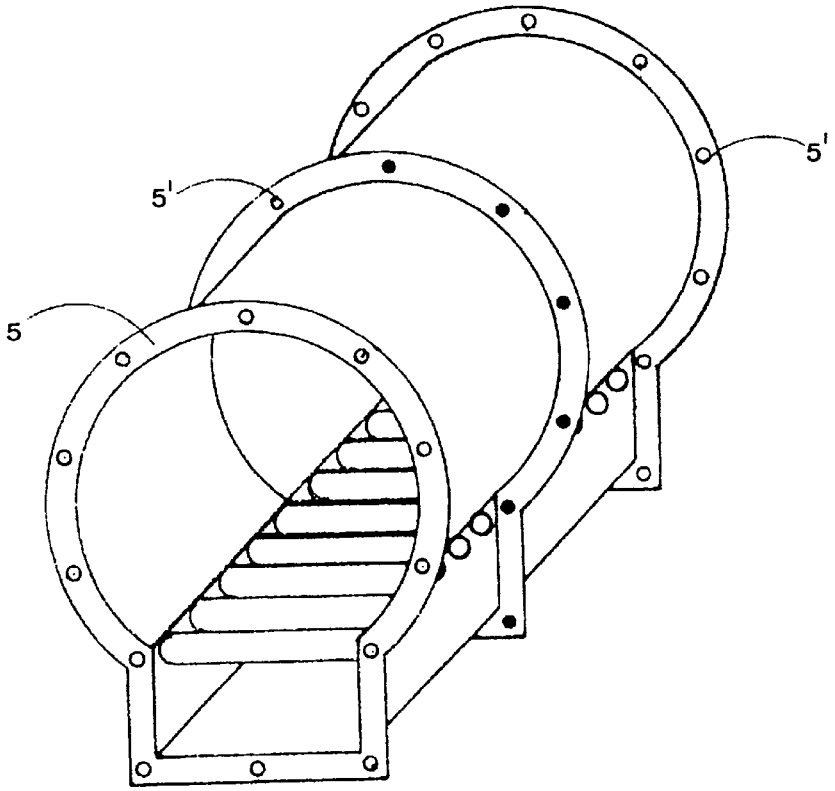
FIG. 10 is a perspective view of the two cells of FIG. 9 engaged together.
Figure 11:
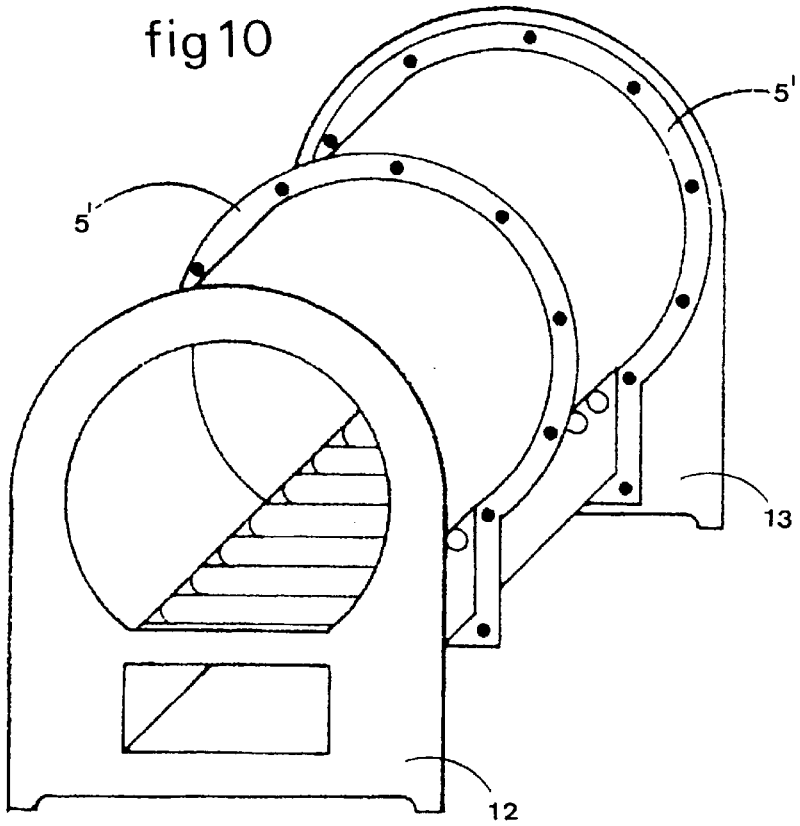
FIG. 11 is a perspective view of the two cells of FIG. 10 assembled with a front and back panel.

Use of a single cell 1 provides for creation of minimum heating power. In the case of use of solid fuels, an increase of heat can be produced by adding more cells behind the first cell as shown in FIGS. 9–11. The system of FIGS. 9–11 is produced by first dismantling of the back side 13 of cell 1 and bolting of an additional cell behind the first with fasteners 41 as in FIGS. 9–11.

Figure 6:
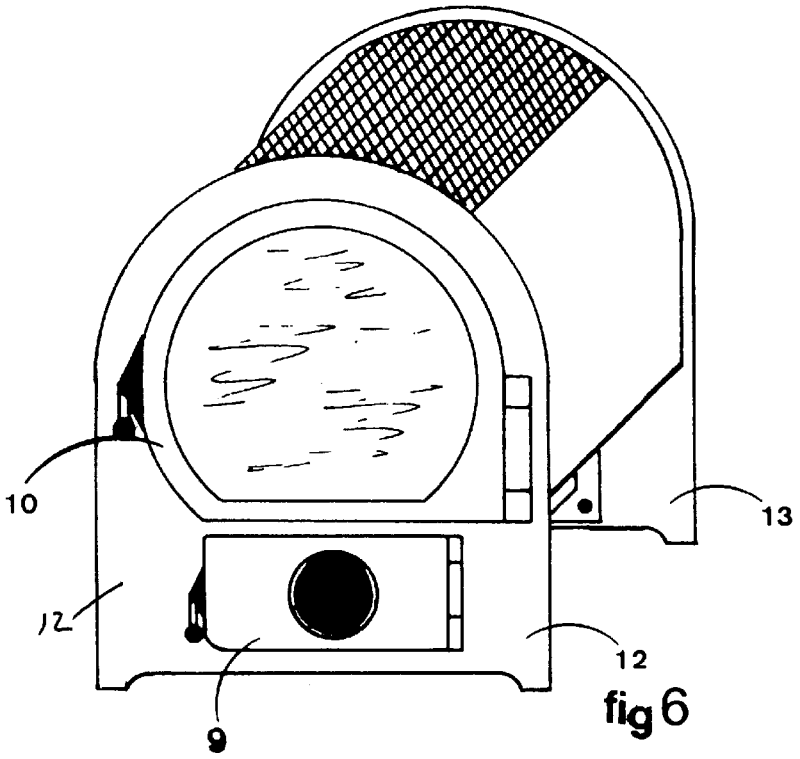
FIG. 6 is a perspective view of an assembled heating system having a single cell according to the invention for use as a stove for burning solid fuel.
Figure 7:
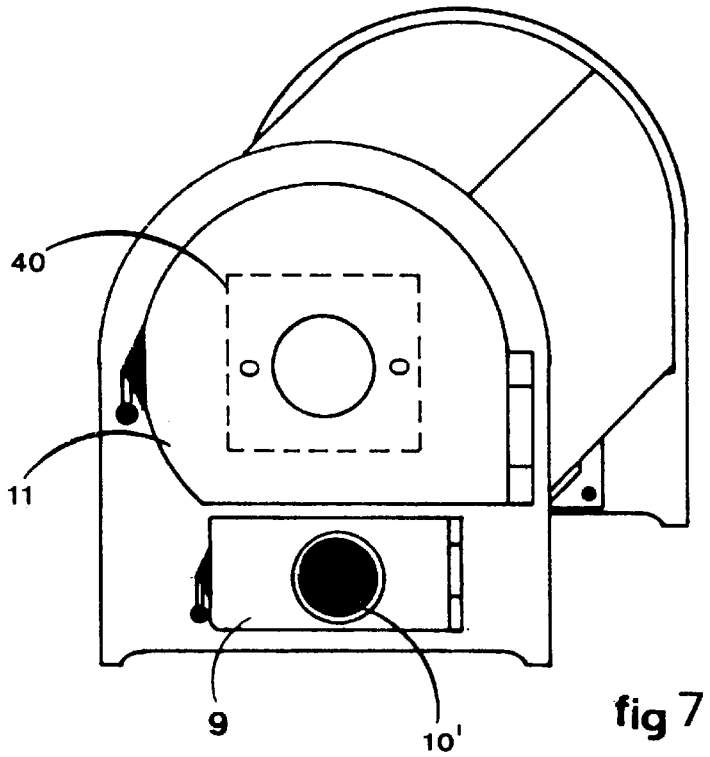
FIG. 7 is a perspective view of an assembled heating system having a single cell according to the invention for use as a stove for burning liquid or gaseous fuel.
Figure 8:
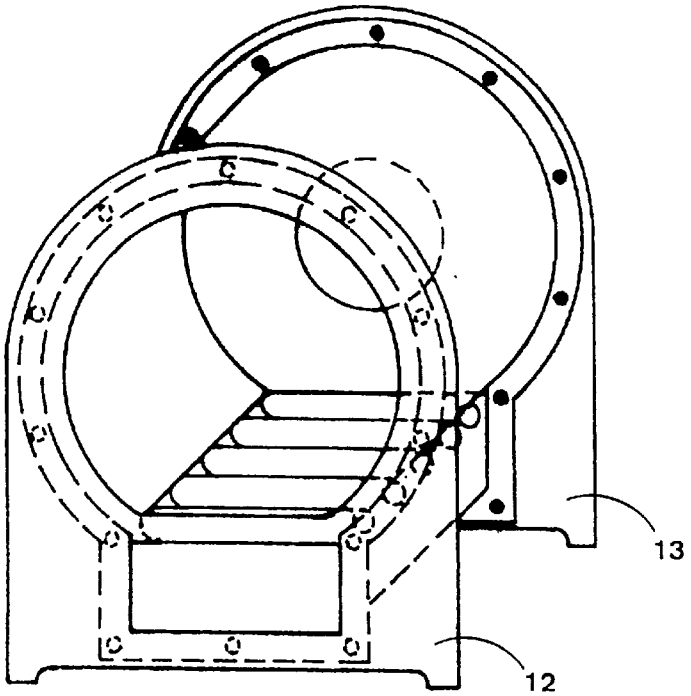
FIG. 8 is a perspective view of the cell of FIG. 1 with a front and back panel mounted.

Re-installing the back side 13, containing the opening 3 for evacuation of smoke, is done on the added cell in the same manner as done on the first initial cell 1. The assembly of FIG. 11 can also be reached by removing the front panel 12 of an assembled unit, such as shown in FIGS. 6 or 7, and adding the additional cells at that point.

Figure 5:
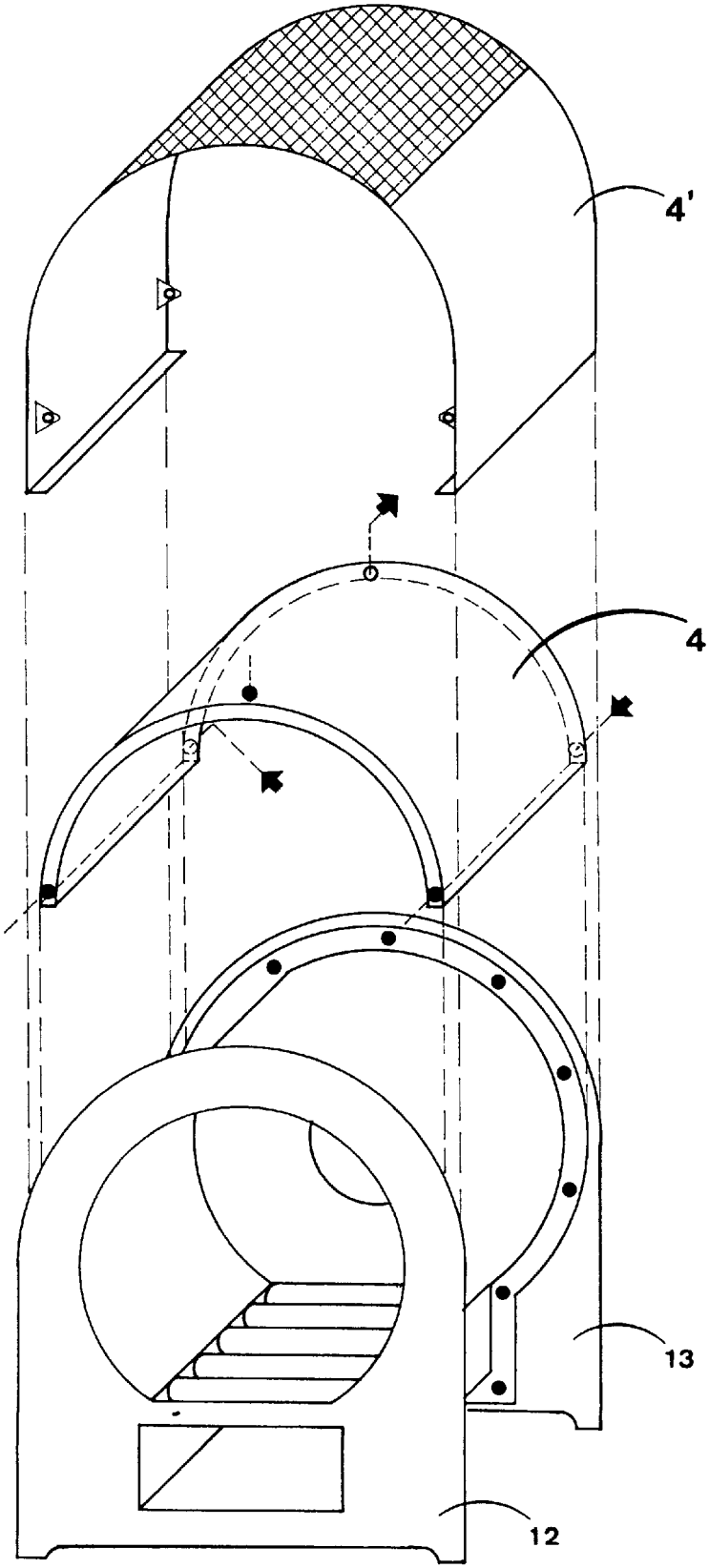
FIG. 5 is an exploded perspective view of the modular cell of FIG. 1 including a casing.

It is to be noted that the modular cell 1 is equipped at both ends by a vertical stand 5, 5'. The vertical stands 5, 5' ensure the rigidity of the cell, a breaking point between adjacent cells and stability on the ground. The stands also deal with producing housing 7 in which forced exterior air circulates within, after fastening the casing 4 and 4', shown in FIG. 5 on each module.

The transformation of the system to solid combustible (coal, wood) to a liquid combustible (fuel or gas), is realized through the replacement of the front main door 10 by another door 11 equipped on a back side with an appropriate burner 40 which consumes the liquid or gas fuels in the assembled heating system.

Figure 12:
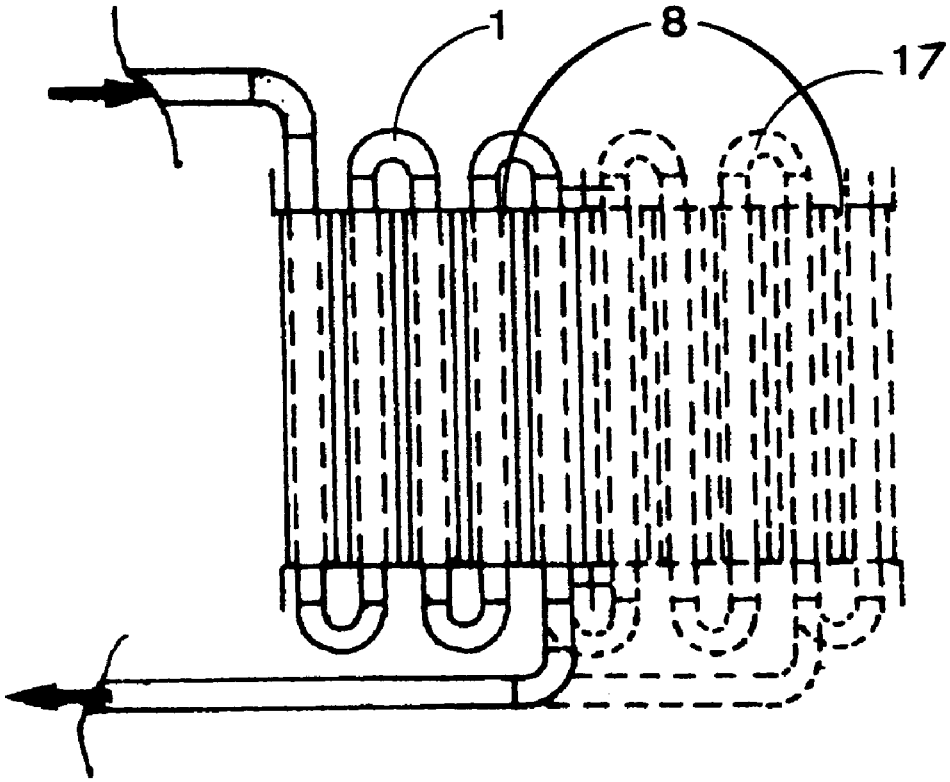
FIG. 12 is a plan view of liquid tubing engaged through the conduits of one or two adjacent cells of FIG. 1.
Figure 13:
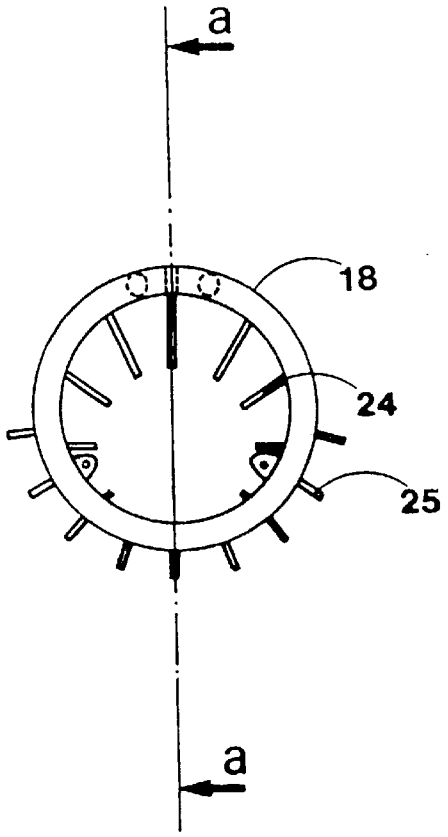
FIG. 13 is a front elevation view of a radiator for use with the heating system according to the invention when used as a boiler.
Figure 14:
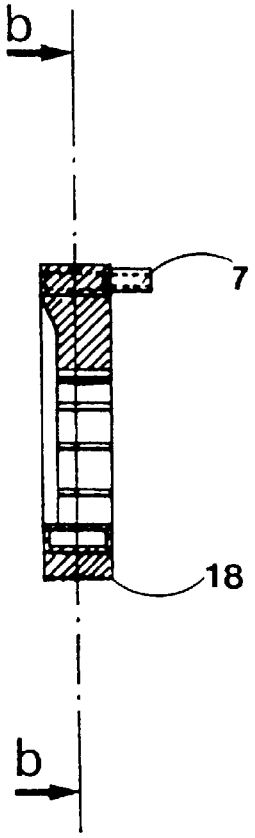
FIG. 14 is a sectional view along section a—a of FIG. 13.
Figure 15:
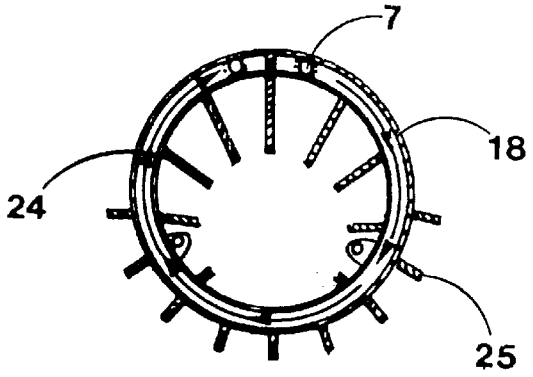
FIG. 15 is a sectional view along section b—b of FIG. 14.
Figure 16:
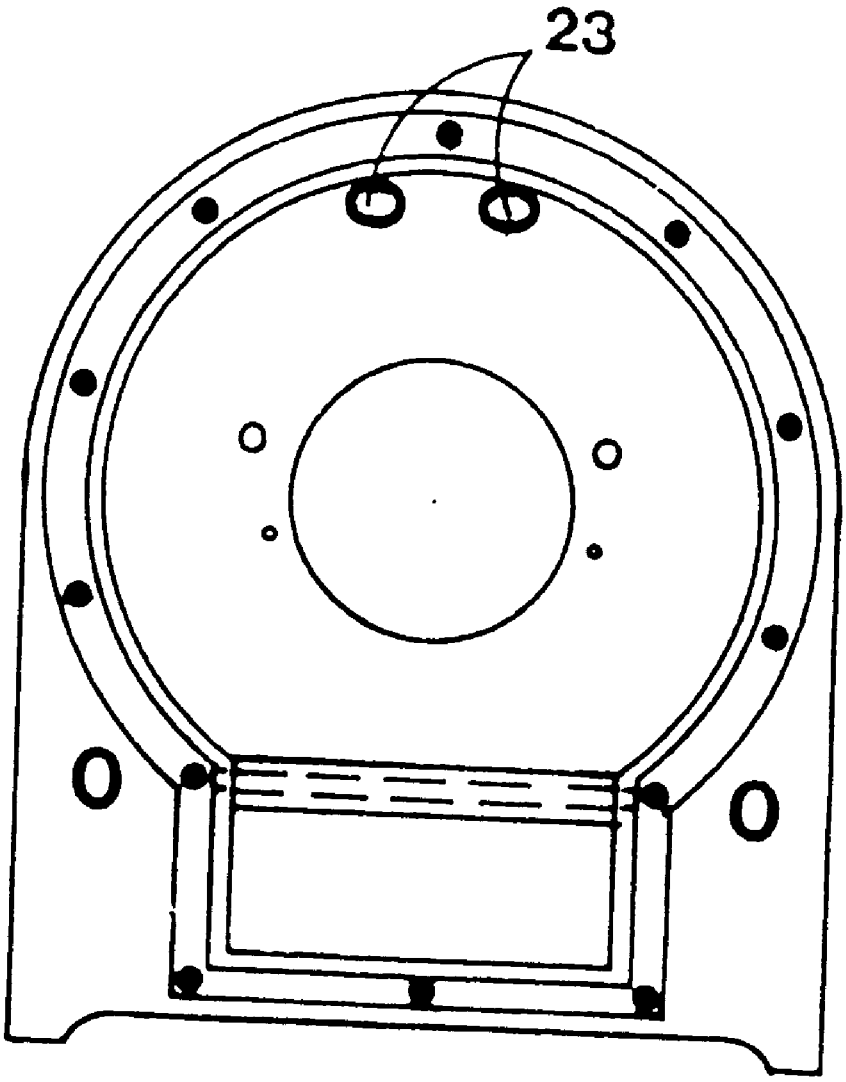
FIG. 16 is a back elevation view of the back panel of 4 mounted to a back stand of the cell of FIG. 1.
Figure 18:
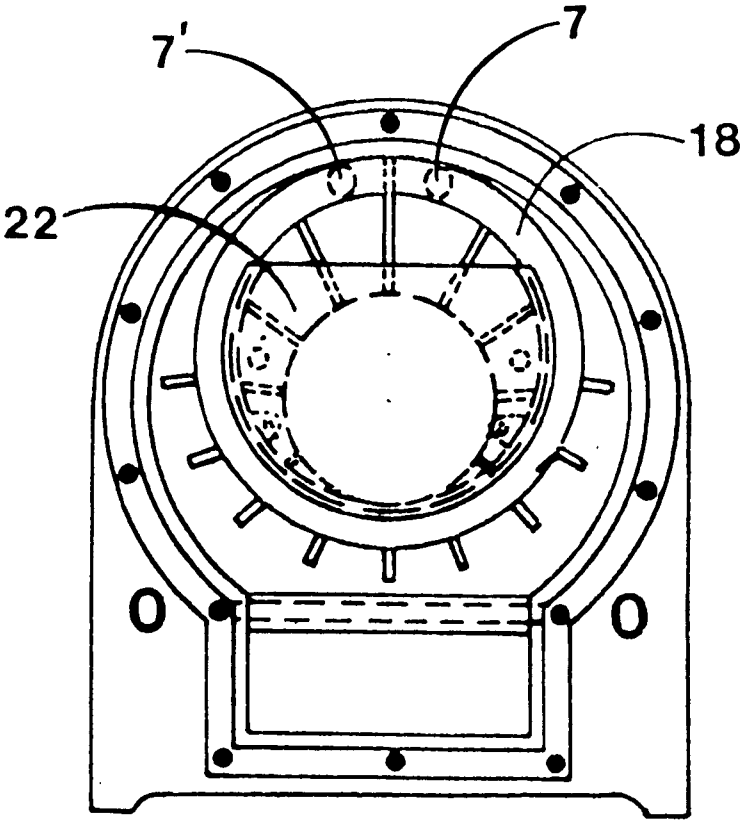
FIG. 18 is a back elevation view of FIG. 17.
Figure 17:
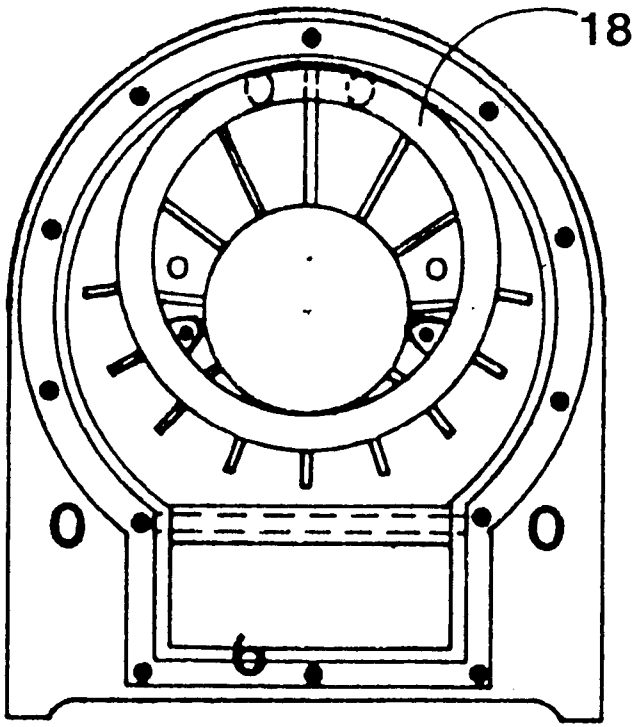
FIG. 17 is a front elevation view of the back panel of FIG. 4 with a radiator mounted thereon.

With respect to producing a unicellular (see FIGS. 6 and 7) or multicellular stove, such as in FIG. 11, into a boiler, a radiator 17 with inlet and outlet projections 7, 7' is engaged in openings 23 as shown in FIGS. 17 and 18. The fluid, heated in the housing 7 as it passes through tubing 18 (see FIG. 12) to radiator 18, enters the radiator 18 at inlet projection 7 and heats fins 24 and 25 before leaving radiator 18 at outlet projection 7'.

In the case of a boiler, it is to be noted that passing from a system of solid combustible (coal, wood) to a liquid or gas combustible is done by adapting a burner 40, on the back side of door 11. To increase the heating power of the boiler, the volume of the radiator 18 situated on the back panel 13 can be increased.

Figure 1:
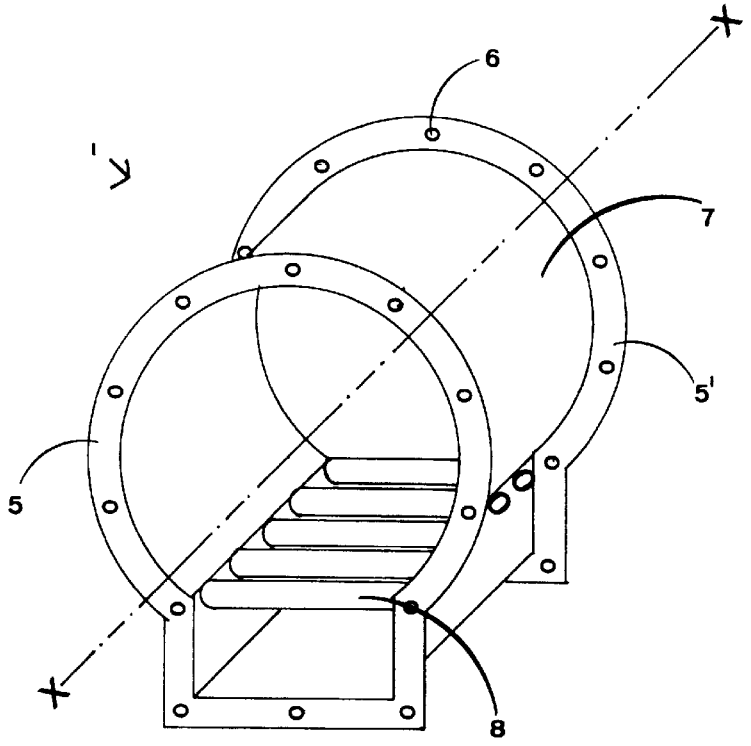
FIG. 1 is a perspective view of the modular cell according to the invention.
Figure 2:
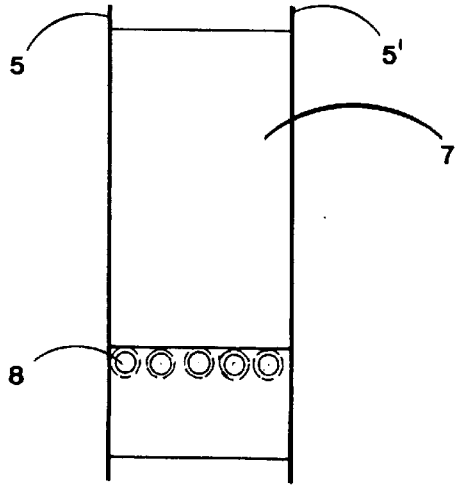
FIG. 2 is a side elevation view of the modular cell of FIG. 1.

The modular cell 1 in its basic form, as shown in FIGS. 1 and 2, includes a plurality of conduits 8 in which the tubing 18 extends through while fluid passes in the tubing 18 in the configuration of the boiler. The function of the front panel 12 is to define the front side of the cell while receiving a main door 10 for use with a solid combustible (coal, wood), or a main door 11 equipped with a burner 40 for use with liquid or gas combustibles.

Figure 20:
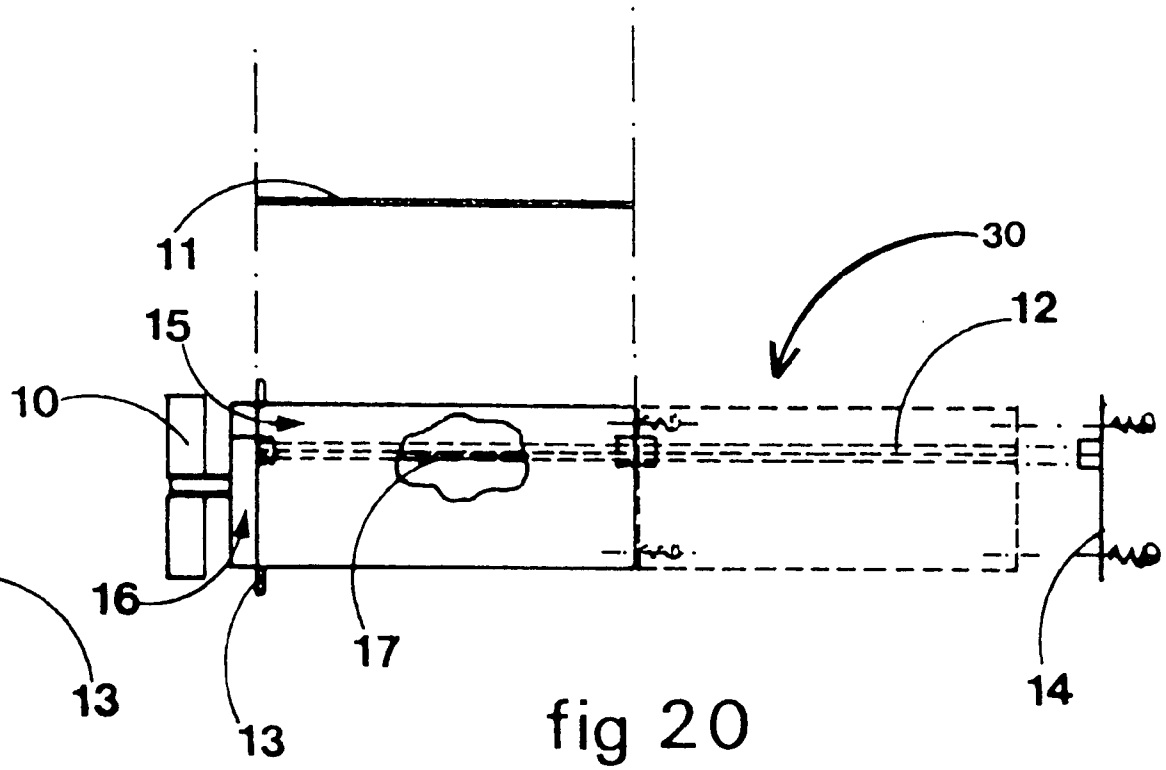
FIG. 20 is a side view of the ash-pan of FIG. 19.
Figure 19:
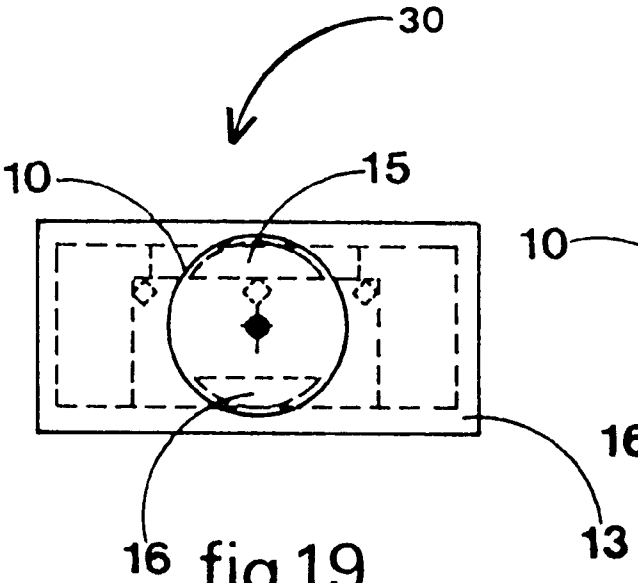
FIG. 19 is a front elevation view of the ash-pan according to the invention.
Figure 21:
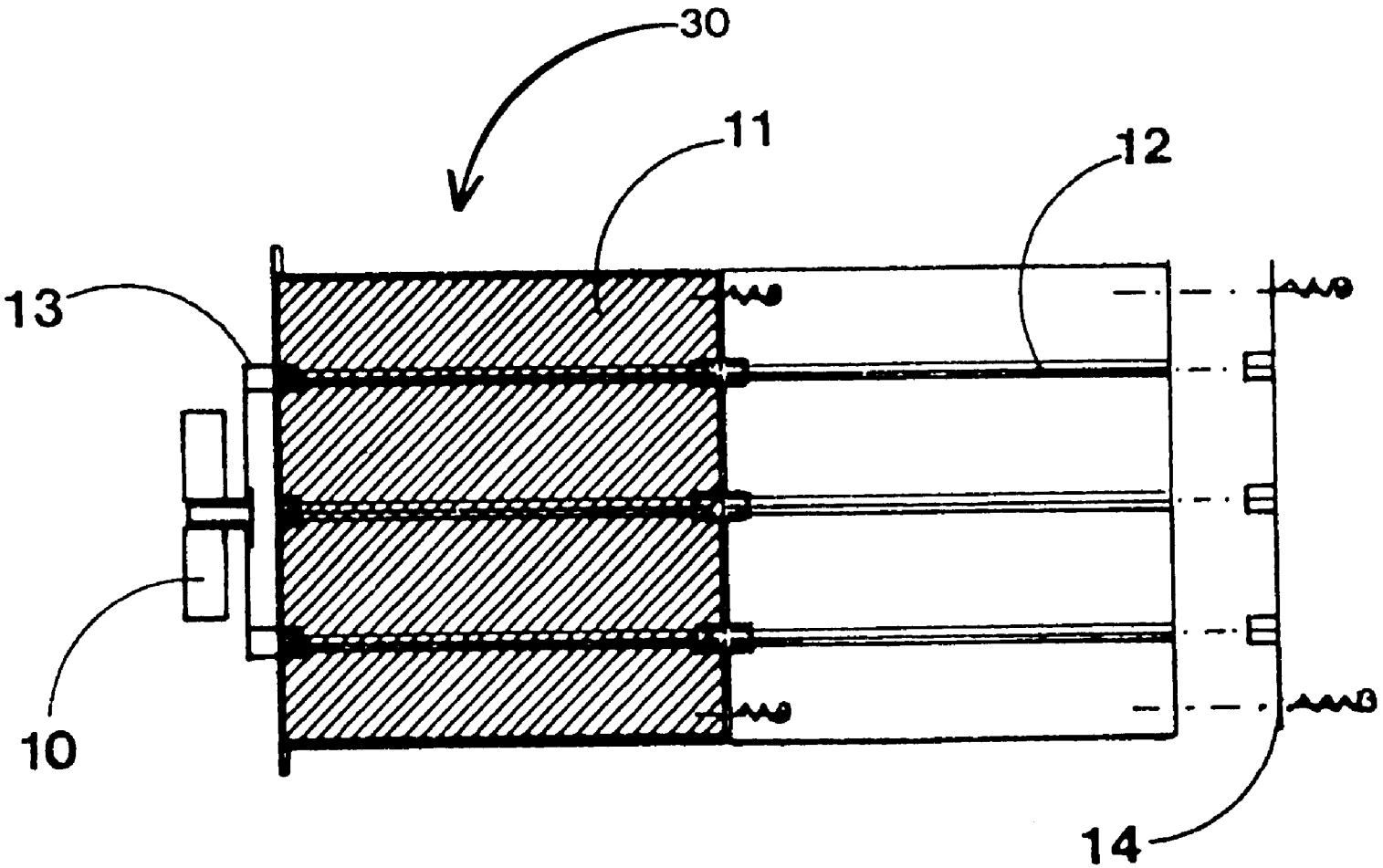
FIG. 21 is a plan view of the screen and adjacent ash-pans according to the invention.
Figure 23:
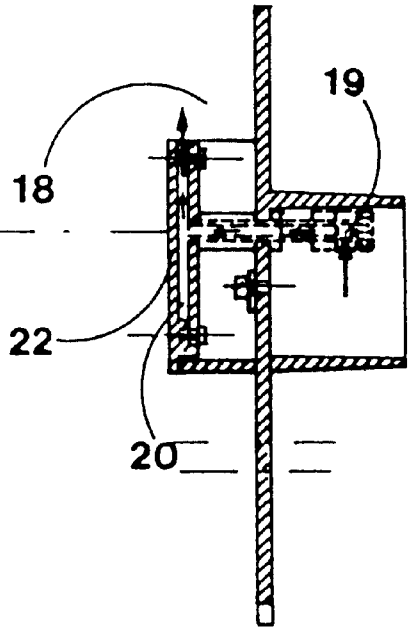
FIG. 23 is a sectional view along section c—c of FIG. 22.
Figure 22:
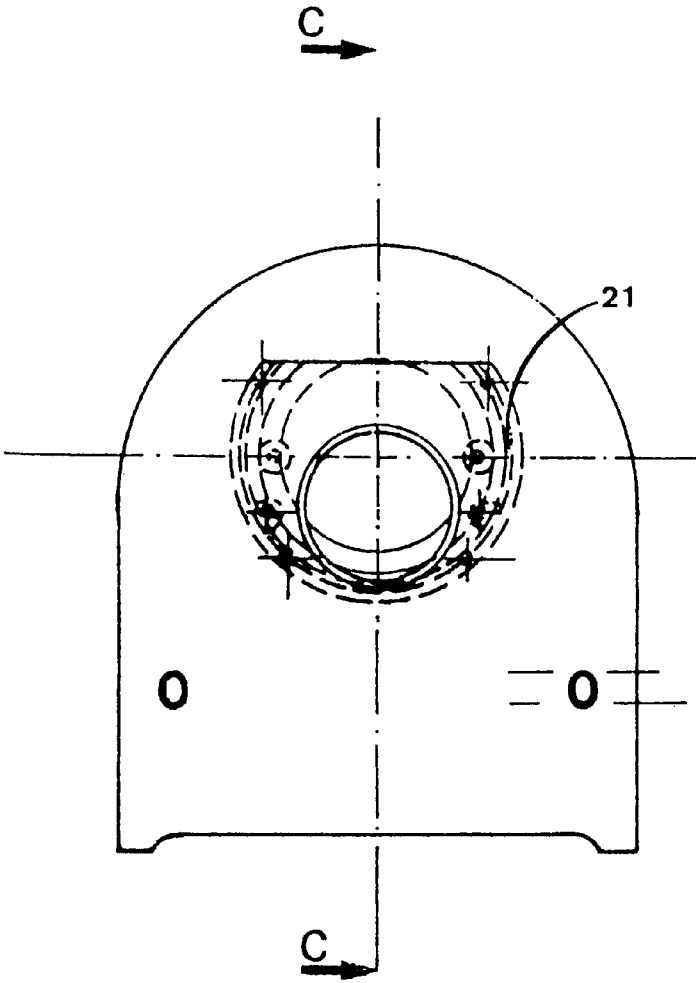
FIG. 22 is a back elevation view of the back panel of FIG. 4 with a deflector mounted thereon.
Figure 24:
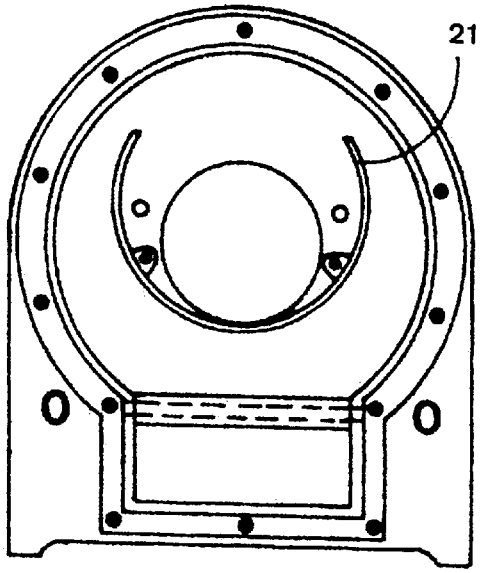
FIG. 24 is a front elevation view of the back panel of FIG. 4 with a deflector support engaged thereon.
Figure 25:
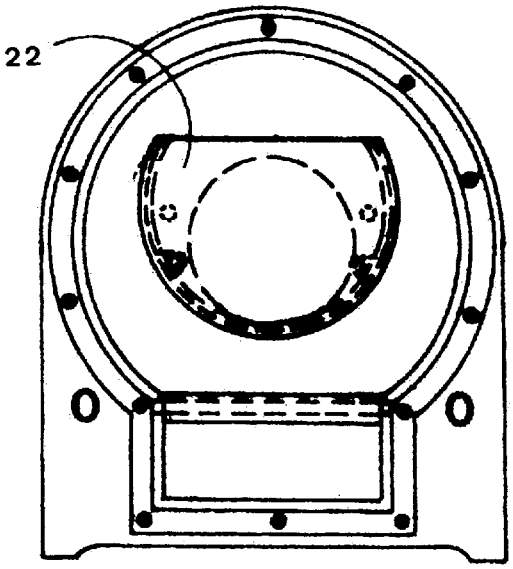
FIG. 25 is a front elevation view of the back panel of FIG. 4 with the deflector mounted thereon.

The front panel 12 also includes a second door 9 which gives access to the ash-pan 30 (shown in FIGS. 19–21). The front side of the ash-pan has a pull handle 10'. It is to be noted that when a liquid or gas combustible I used, the pull handle 10' remains closed.

The ash-pan 30 receives a grill 11 (see FIGS. 20 and 21), fixed longitudinally along the axis of the cell, which is holds, on one hand, the coals still susceptible to radiate efficiently in the heart of the cell, and on the other hand, pass through ash created by burning the coal.

The ash-pan 30 of each cell is provided with hollow conduits 12 with sections in the form of lozenges all through its length (see FIGS. 20 and 21). The ash-pan 30 is also provided with a front side 13 and a back side 14. The front side a holds handle 10 that contains two separate openings (15, 16). Opening 15 provides passage of primary air that enters in the heart of the cell, while opening 16 provides access for the primary air to the hollow conduits 12. The hollow conduits 12 are disposed in parallel and longitudinally in such a way that two opposed sides lie in a vertical plane. The upper surfaces of the sides are closed, which allows the ashes to slip to the bottom of the ash-pan without clogging the conduit. The bottom of the conduits are open in such a way that primary air can penetrate and favor the combustion of particles not totally consumed and retained on the grill 11 of the ash-pan 30.

During the assembly of several cells, the ash-pan 30 of each of the cells are interlocked in series. Further, the front and back sides of the ash-pan are removable. The back panel 13 has a mission to separate the front side of an adjacent cell while receiving the smoke exhaust in a precise channel by deflector 22 that drives the smoke to reburning. The admission of such secondary air is regulated by one or two taps 19, possessing the same functions fixed on the back panel 13 of the cell (see FIG. 19).

When converted to use as a stove, the back panel 13 of the cell receives a support 21 allowing the setting up of the deflector 22. The back panel 13 is also provided with through holes which have plugs 23 that remain fixed in place while the system is used as a stove.

This same back panel 13, in the case where the stove is converted to a boiler, receives radiator 18 after dismantling the support 21.

The radiator 18 is of circular form, has inner fins 24 and exterior fins 25 conceived to allow the distribution of thermal energy in an optimum manner. When the system is used as a boiler, plugs 23 are removed in order to allow the insertion of inlet and outlet projections 7, 7' of the radiator. FIG. 18 shows an assembly of the radiator 18, as well as the deflector 22.

The whole of the apparatuses, as above described, are capped with a casing 4 and 4'.

What is claimed is:

1. An expandable, convertable and multifuel heating system comprising:

at least one cell (1), a front stand (5) and a back stand (5') at opposite ends of the cell, each of which have a plurality of through holes (5');

a housing (7) engaged between the front stand and back stand;

a plurality of conduits (8) extending through the housing (7) transverse to a longitudinal axis of the cell and open on opposite walls of the housing (7);

and an ash-pan (30) located below the plurality of conduits;

wherein, when a plurality of said cell is utilized, each adjacent cell is separably engaged to each other by fastening a back stand to a corresponding front stand by a fastener extending through the plurality of holes on the back stand and the front stand while each adjacent ash pan is engaged to each other;

the heating system further comprising;

a front panel (12) separably fastened to the front stand (5) of an initial cell;

a main door (10, 11) and an ash-pan door (9) hinged on said front panel (12);

a back panel (13) separably fastened to the back stand (5') of a last cell given a heating system having a plurality of said cell or to the initial cell given a heating system having a single cell;

the back panel (13) having an exhaust port (3) for venting and plugged connections (23) for radiator means for dispensing heat.

2. The heating system of claim 1, wherein when used as a stove to burn solid fuels further comprises a screen positioned in the initial cell over a top of said conduits; and deflector means for directing the exhaust for reburning, the deflector means being separably engaged to the back panel of the last cell.

3. The heating system of claim 1, wherein when used as a boiler further comprises radiator means for dispensing heat, the radiator means being engaged through the connectors on the back panel, the radiator having an inlet and an outlet for liquid heated within the housing; and tubing sections separably engaged together running from a liquid source through said plurality of conduits to the inlet of the radiator and from the outlet of the radiator back to the liquid source to move the liquid in and out of the radiator.

4. The heating system of claims 1, wherein when used as a boiler using only liquid or gaseous fuels further comprises a burning means for burning liquid or gaseous fuels engaged to an inner side of the main door within the initial cell.

5. The heating system of claim 3, wherein said radiator is circular and has fins projecting from a circumference thereof to dispense heat.

* * * * *